US007542713B2

(12) United States Patent
Yoshida

(10) Patent No.: US 7,542,713 B2
(45) Date of Patent: Jun. 2, 2009

(54) IMAGE FORMING APPARATUS CAPABLE OF EFFECTIVELY FORMING A QUALITY IMAGE WITHOUT CAUSING A VERMICULATE-LIKE FALSE IMAGE

(75) Inventor: Ken Yoshida, Chigasaki (JP)

(73) Assignee: Ricoh Company Ltd., Tokyo (JP)

( * ) Notice: Subject to any disclaimer, the term of this patent is extended or adjusted under 35 U.S.C. 154(b) by 238 days.

(21) Appl. No.: 11/560,681

(22) Filed: Nov. 16, 2006

(65) Prior Publication Data

US 2007/0127960 A1 Jun. 7, 2007

(30) Foreign Application Priority Data

Nov. 18, 2005 (JP) ..... 2005-333479

(51) Int. Cl.
*G03G 21/00* (2006.01)

(52) U.S. Cl. ..... 399/346

(58) Field of Classification Search ..... 399/343, 399/344, 345, 346, 35, 357
See application file for complete search history.

(56) References Cited

U.S. PATENT DOCUMENTS

| | | | | |
|---|---|---|---|---|
| 6,775,511 | B2 * | 8/2004 | Kosuge | 399/346 |
| 6,778,805 | B2 * | 8/2004 | Kai et al. | 399/346 |
| 7,003,238 | B2 | 2/2006 | Yoshida et al. | |
| 7,035,582 | B2 * | 4/2006 | Suda et al. | 399/346 |
| 2007/0127960 | A1 | 6/2007 | Yoshida | |

FOREIGN PATENT DOCUMENTS

| | | | |
|---|---|---|---|
| JP | 57-17973 | | 1/1982 |
| JP | 6-332324 | | 12/1994 |
| JP | 7-271142 | | 10/1995 |
| JP | 8-211755 | | 8/1996 |
| JP | 2000-19858 | | 1/2000 |
| JP | 2001-75449 | | 3/2001 |
| JP | 2002-23447 | * | 1/2003 |
| JP | 2003-330320 | | 11/2003 |
| JP | 2004-325923 | | 11/2004 |
| JP | 2005-266138 | | 9/2005 |

OTHER PUBLICATIONS

U.S. Appl. No. 12/119,050, filed May 12, 2008, Muto et al.
U.S. Appl. No. 12/163,335, filed Jun. 27, 2008, Yoshida.

* cited by examiner

*Primary Examiner*—Hoan H Tran
(74) *Attorney, Agent, or Firm*—Oblon, Spivak, McClelland, Maier & Neustadt, P.C.

(57) ABSTRACT

An image forming apparatus forming an image without causing a vermiculate image and a curled-up blade, includes an image carrying mechanism, an intermediate transfer member, a primary transfer mechanism, a secondary transfer mechanism, and a lubricant supply mechanism. The image carrying mechanism carries primary separate color toner images. The intermediate transfer member contacts the image carrying mechanism. The primary transfer mechanism sequentially transfers the primary separate toner images onto the intermediate transfer member at a specific position into a color toner image. The secondary transfer mechanism contacts the intermediate transfer member and transfers the color toner image onto a recording medium. The lubricant supply mechanism supplies a lubricant to the image carrying mechanism, the intermediate transfer member, and/or the secondary transfer mechanism. The lubricant supply mechanism includes an adjusting mechanism to adjust an amount of supplying the lubricant.

12 Claims, 9 Drawing Sheets

FIG. 5

| | INTERMEDIATE TRANSFER BELT | SECONDARY TRANSFER ROLLER |
|---|---|---|
| 0.20 | — | — |
| 0.30 | — | — |
| 0.32 | — | 75000 |
| 0.35 | 80000 | 10000 |
| 0.45 | 5000 | 100 |

FIG. 8

| CONDITION NO. | LUBRICANT COATING | | | PROBLEMS | | |
|---|---|---|---|---|---|---|
| | PHOTOCONDUCTOR | INTERMEDIATE TRANSFER BELT | SECONDARY TRANSFER ROLLER | BLADE CURL-UP | VERMICULATION | ABILITY OF IMAGE TRANSFER |
| 1 | COATED | COATED | COATED | OK | NG | NG |
| 2 | NO | COATED | COATED | OK | NG | NG |
| 3 | COATED | COATED | NO | OK | NG | NG |
| 4 | COATED | NO | COATED | OK | BORDERLINE | BORDERLINE |
| 5 | NO | NO | COATED | OK | OK | OK |
| 6 | COATED | NO | NO | OK | OK | OK |
| 7 | NO | COATED | NO | OK | NG | NG |
| 8 | NO | NO | NO | NG | OK | OK |

IMAGE FORMING APPARATUS CAPABLE OF EFFECTIVELY FORMING A QUALITY IMAGE WITHOUT CAUSING A VERMICULATE-LIKE FALSE IMAGE

BACKGROUND OF THE INVENTION

1. Field of the Invention

The present invention relates to an image forming apparatus, and more particularly to an image forming apparatus capable of effectively forming a quality image without causing problematic phenomena such as a vermiculate-like false image and a curled-up cleaning blade.

2. Discussion of the Related Art

A related art electrophotographic color image forming apparatus employing an intermediate transfer member transfers primary separate color toner images formed on a plurality of image carrying members sequentially onto the intermediate transfer member at a position into a color image. The color image intermediately formed on the intermediate transfer member is then transferred onto a recording medium. In such an image forming apparatus, the plurality of image carrying members are of photoconductive. Also, the intermediate transfer member includes a belt extended between a plurality of rollers. Each of the primary image transfer from the image carrying member to the intermediate transfer member and the secondary image transfer from the intermediate transfer member to a recording medium is conducted by generating an electric field.

The above-described related art image forming apparatus has a problematic nature to cause a vermiculate image, i.e., a part of a tone image is not sufficiently transferred during the primary image transfer process. As a result, an image has a relatively low density or a density drop in a vermiculation-like shape, particularly around a middle portion of the image. For example, to address this problem, it is needed to apply a lubricant to the image carrying member to reduce a friction coefficient of a surface of the image carrying member so as to reduce an attraction force between the surface of the image carrying member and the toner.

However, the friction coefficient acted between the surface of the image carrying member and the toner relates not only to the nature of image transfer but also to another problematic phenomenon called a curled-up cleaning blade. To address this problem of curled-up cleaning blade, coating a lubricant is also effective. Therefore, suitable conditions for lubricant coating and friction coefficient are needed to address these two problems at the same time.

Currently, there is no image forming apparatus that is provided with an effective mechanism to eliminate the above-described problems at the same time.

SUMMARY OF THE INVENTION

This patent specification describes an image forming apparatus which can effectively form a quality image without causing problematic phenomena such as a vermiculate image and a curled-up blade. In one example, an image forming apparatus includes an image carrying member, an intermediate transfer member, a primary transfer member, a secondary transfer member, and a lubricant supply mechanism. The image carrying member is configured to carry a plurality of primary separate color toner images thereon. The intermediate transfer member is held in contact with the image carrying member and is configured to rotate. The primary transfer member is configured to sequentially transfer the plurality of primary separate toner images from the image carrying member onto the intermediate transfer member at a specific position into a color toner image. The secondary transfer member is held in contact with the intermediate transfer member and is configured to transfer the color toner image from the intermediate transfer member onto a recording medium. The lubricant supply mechanism is configured to supply a lubricant to at least one of the image carrying member, the intermediate transfer member, and the secondary transfer member. The lubricant supply mechanism includes adjusting mechanism configured to adjust an amount of supplying the lubricant to the at least one of the image carrying member, the intermediate transfer member, and the secondary transfer member.

This patent specification further describes a lubricant supply apparatus for use in an image forming apparatus using an intermediate transfer member. In one example, a lubricant supply apparatus includes a lubricant and an adjusting mechanism. The adjusting mechanism is configured to adjust an amount of supplying the lubricant in response to a variation of a friction coefficient of a surface of the intermediate transfer member.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 5 is a table for explaining a relationship between an occurrence of a curling up phenomenon on a belt cleaning blade and a difference of surface friction coefficient between a photoconductor and an intermediate transfer belt;

FIG. 8 is a table for summarizing results of a lubrication survey applied to the photoconductor, the intermediate transfer belt, and a secondary transfer roller in various conditions;

DETAILED DESCRIPTION OF PREFERRED EMBODIMENTS

Figure 1:
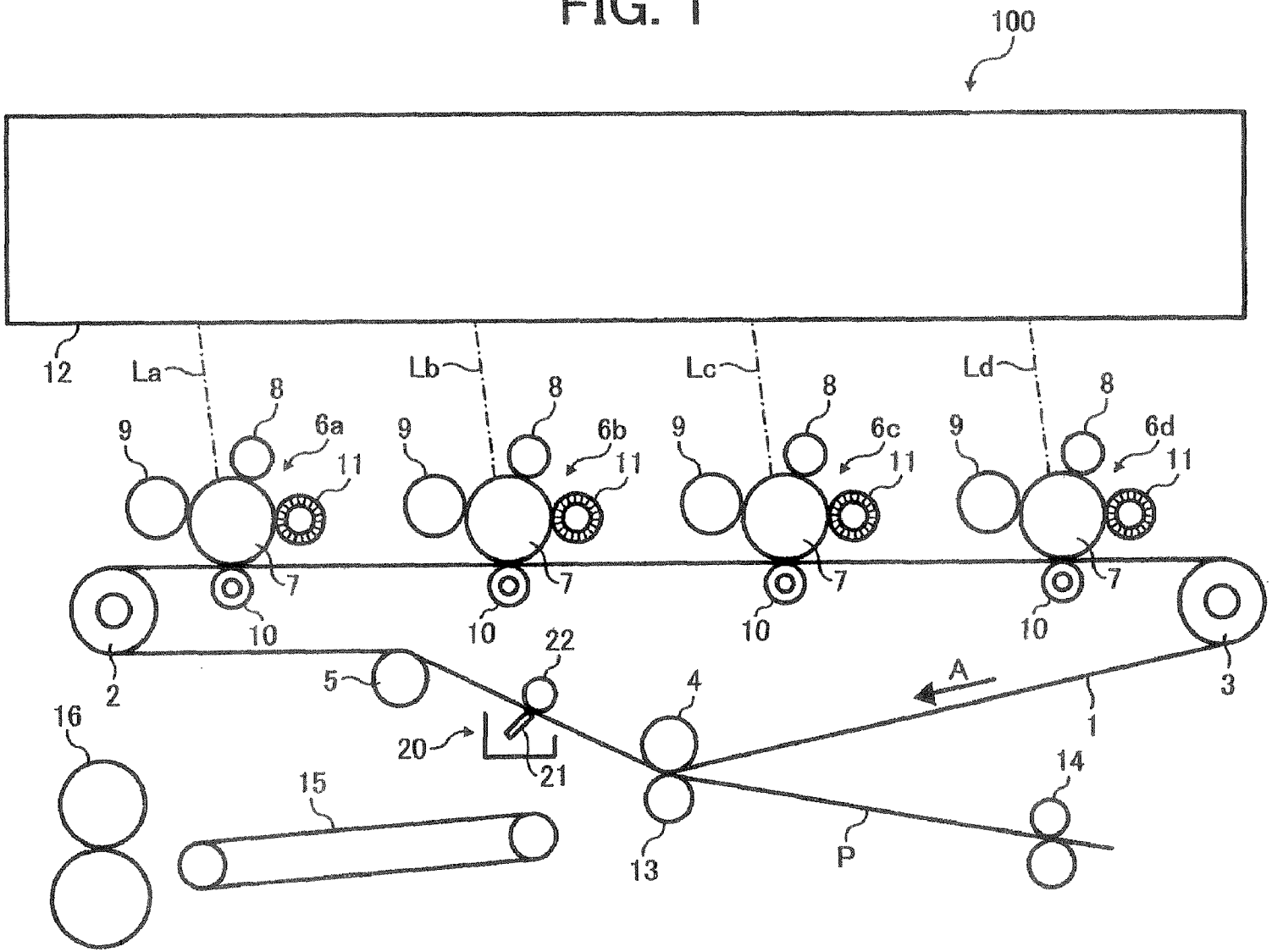
FIG. 1 is a schematic diagram of a color image forming apparatus according to an embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, a color image forming apparatus 100 according to an exemplary embodiment of the present invention is explained. As illustrated in FIG. 1, the color image forming apparatus 100 includes an intermediate transfer belt 1, rollers 2-5, and image forming units 6*a*, 6*b*, 6*c*, and 6*d*.

The intermediate transfer belt 1 serves as an image carrying member and is extended between the rollers 2-5. One of the rollers 2 and 3 is used as a driving roller to rotate in a clockwise direction as indicated by an arrow A. The image forming units 6*a*-6*d* are disposed on an upper sliding surface of the intermediate transfer belt 1, as illustrated in FIG. 1. The image forming units 6*a*-6*d* have a common structure but are used for toner of different colors such as magenta, cyan, yellow, and black, respectively.

Since the image forming units 6*a*-6*d* have a common structure, as described above, a representative of the image forming units 6*a*-6*d* may conveniently be denoted by a reference numeral 6 without a suffix of a, b, c, or d in a description below. Each of the image forming units 6*a*-6*d* includes a photoconductor 7 having a drum-like shape, a charging roller 8, a developing unit 9, a primary transfer roller 10, and a cleaning unit 11. The charging roller 8, the developing unit 9, the primary transfer roller 10, and the cleaning unit 11 are disposed at positions surrounding the photoconductor 7, as illustrated in FIG. 1.

The color image forming apparatus 100 further includes an optical writing unit 12, a secondary transfer roller 13, a registration roller pair 14, a sheet transportation belt 15, a fixing roller pair 16, and a belt cleaning unit 20. The optical writing unit 12 is configured to output laser beams La, Lb, Lc, and Ld optically modulated in accordance with primary separate color data of an image, towards a surface of the photoconductor 7. The laser beams La-Ld correspond to magenta, cyan, yellow, and black color data of an image, but a laser beam L may represent them on an as needed basis in a description below, as is the case with the representation of the image forming units 6*a*-6*d*.

Figure 2:
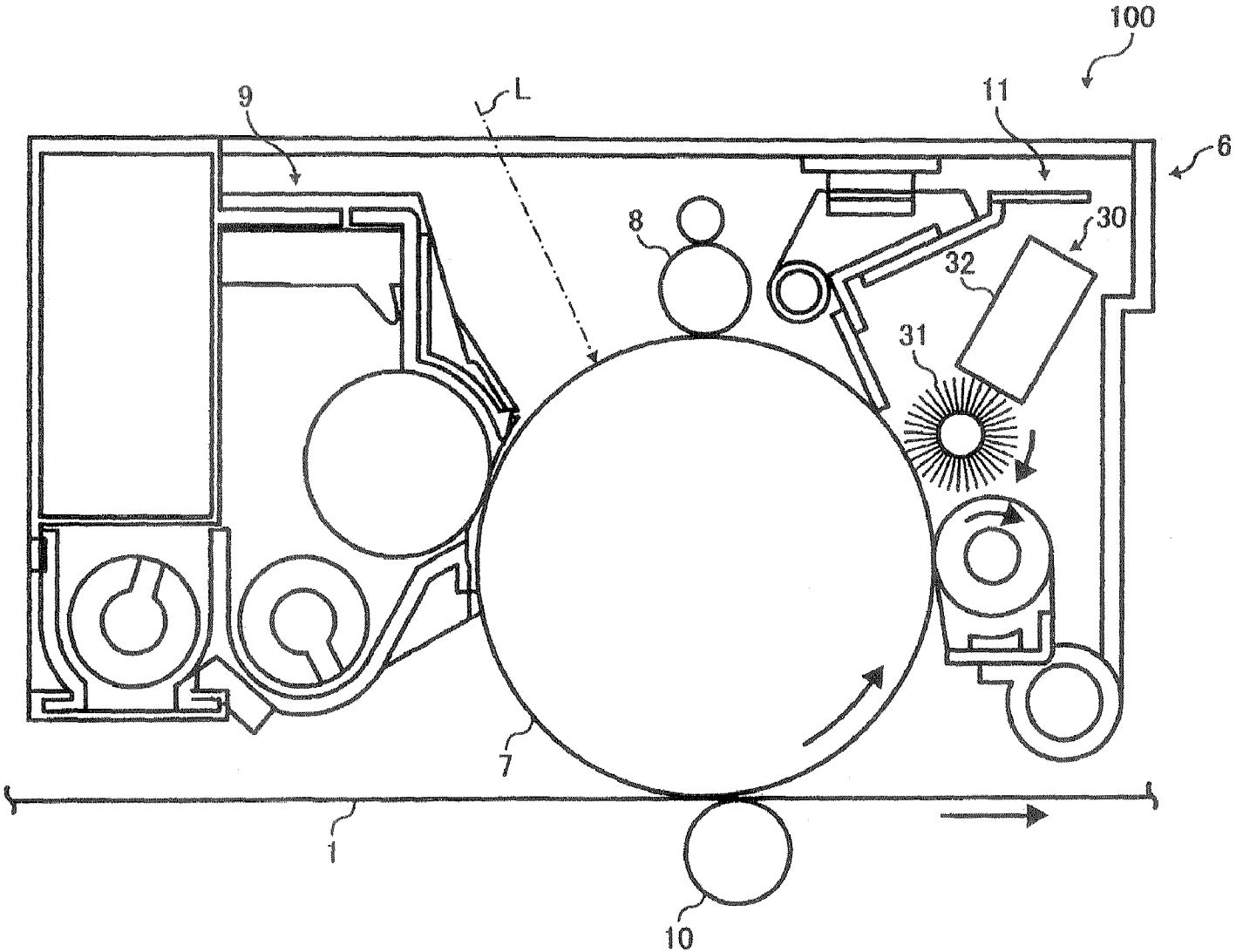
FIG. 2 is a schematic diagram of one of a plurality of image forming units included in the color image forming apparatus of FIG. 1.

As illustrated in FIG. 2, the photoconductor 7 is driven to rotate counterclockwise line by line in a sub-scanning direction at a constant speed so as to have a circumferential surface thereof evenly charged of a specific polarity with the charging unit 8. Also, the photoconductor 7 is exposed to the optically modulated laser beam L that scans the evenly charged circumferential surface of the photoconductor 7 along a scanning line in a main scanning direction. As a result, an electrostatic latent image of a specific separate color (e.g., a magenta color) is formed on the circumferential surface of the photoconductor 7. The electrostatic latent image is then developed into a visible toner image of a specific separate color (e.g., a magenta color) with the developing unit 9.

The thus-formed toner image is transported by the rotation of the photoconductor 7 to a primary transfer region where the photoconductor 7 faces the primary transfer roller 10 via the intermediate transfer belt 1. The primary transfer roller 10 is charged with a voltage of a polarity opposite to that of the toner so that the toner image is transferred onto the intermediate transfer belt 1. The toner slipping through and remaining on the photoconductor 7 after the primary transfer process becomes a contaminant and therefore needs to be removed by the cleaning unit 11.

In this way, the image forming units 6*a*-6*d* form magenta, cyan, yellow, and black color toner images, respectively. These color toner images are transferred sequentially in this order onto the intermediate transfer belt 1 at a specific position by the primary transfer rollers 10 so as to overlay the four separate color images into a full color toner image. Then, the intermediate transfer belt 1 transports the overlaid full color toner image to a secondary transfer region where the secondary transfer roller 13 faces the roller 4 via the intermediate transfer belt 1 and also a recording sheet P (see FIG. 1) is transported via the registration roller pair 14.

As is the same with the primary transfer roller 10, the secondary transfer roller 13 is also charged with a voltage having a polarity opposite to that of the toner. Therefore, the full color toner image is transferred onto the recording sheet P by the action of the charge of the secondary transfer roller 13 in the secondary transfer region. The recording sheet P having the full color toner image thereon is further transported with the transportation belt 15 towards the fixing roller pair 16. The full color toner image is fixed onto the recording sheet P with the fixing roller pair 16, and the recording sheet P is ejected to a finish tray (not shown).

The toner slipping through and remaining on the intermediate transfer belt 1 becomes a contaminant and therefore needs to be removed with the cleaning unit 20. The cleaning unit 20 includes a belt cleaning blade 21 and a backup roller 22. The belt cleaning blade 21 and the backup roller 22 are disposed at positions facing each other via the intermediate transfer belt 1 and held in contact with the intermediate transfer belt 1, as illustrated in FIG. 1.

It is known that the above-described structure using an intermediate transfer belt has a typical nature to produce a vermiculate image, i.e., a phenomenon in which a toner image lacks in part. However, the applicant of this invention experimentally found that the above-mentioned nature hardly appears when a friction coefficient of the surface of the photoconductor 7 is lower than that of the intermediate transfer belt 1.

On the other hand, for a maintenance purpose, various toner patterns may be formed on the intermediate transfer belt 1. For example, the toner patterns are generated in the maintenance such as a toner density adjustment, an image displacement correction, etc. Such a maintenance toner pattern is typically formed on the intermediate transfer belt 1 during a space interval between two adjacent recording sheets. That is, the maintenance toner pattern is not transferred onto the recording sheet P, thereby inevitably contacting the secondary transfer roller 13. As a result, the toner is partly transferred onto the intermediate transfer belt 1 through the secondary transfer roller 13. The cleaning unit 20 is needed to remove such toner remaining on the intermediate transfer belt 1.

In the above-described structure, however, the belt cleaning blade 21 is a typical cleaning mechanism having a blade shape but is apt to cause a defect called a curled-up blade.

The secondary transfer roller 13 is one example of a secondary transfer mechanism and may be replaced with a belt type member.

To avoid both the vermiculate image and the curled-up blade in the belt cleaning blade 21, the color image forming apparatus 100 uses a lubricant supply unit 30 which is disposed inside the cleaning unit 11, as illustrated in FIG. 2.

In one exemplary configuration of the color image forming apparatus 100, the lubricant supply unit 30 supplies the lubricant to the photoconductor 7, the intermediate transfer belt 1, and the secondary transfer roller 13.

In this configuration, the intermediate transfer belt 1 includes a polyimide as a main ingredient. To manufacture the belt in a seamless belt-like shape of a polyimide resin, a polyimide acid solution is prepared and a carbon black is dispersed therein. Then, the carbon-black-dispersed polyimide solution is poured into a metal drum and is dried up. After that, a polyimide film is removed from the metal drum and is stretched under a relatively high temperature, thereby producing an evenly stretched seamless polyimide film. A seamless polyimide film with a desirable width is cut from the thus-produced polyimide film in a drum shape.

An actual forming of the film was conducted according to a general method. That is, the polymer solution with a dispersed carbon black is poured into a cylindrical metal mold. The metal mold containing the polymer solution is rotated (i.e., a centrifugal molding) while being subjected to heat of from approximately 100° C. to approximately 200° C., so that the polyimide film is formed in a seamless belt shape. The thus-prepared film is dried up until it becomes partially hardened and is then removed from the mold. After that, the film is placed on an iron core under a temperature of from approximately 300° C. to approximately 450° C. such that a reaction of the film changing into a polyimide form is accelerated and the film is sufficiently hardened. Thus, the belt is manufactured. During the above-described process, a resistance of the belt can be adjusted by changing a carbon content, a firing temperature, a curing speed, and so forth. The belt produced in this way has a surface friction coefficient of 0.45 measured with a measuring tool, HEDON TRIBOGEAR μs 94i manufactured by iPROS Corporation, Japan.

In connection with the intermediate transfer belt 1, a survey was conducted on how far a difference of the surface friction coefficient between the photoconductor 7 and the intermediate transfer belt 1 affects the problematic phenomenon of a vermiculate image and a performance of an image transfer (i.e., an efficiency of an image transfer). In this survey, the surface friction coefficients of the photoconductor 7 and the intermediate transfer belt 1 are differentiated by adjusting an amount of supplying the lubricant thereto. Specifically, the pressure of a solid lubricant towards the photoconductor 7 and the intermediate transfer belt 1 is varied so as to adjust the lubricant supply amount. As an alternative, it is possible to vary a time period to press the photoconductor 7 and the intermediate transfer belt 1 with a lubricant mechanism, or to change a contact area of the lubricant mechanism with the photoconductor 7 and the intermediate transfer belt 1.

Figure 3:
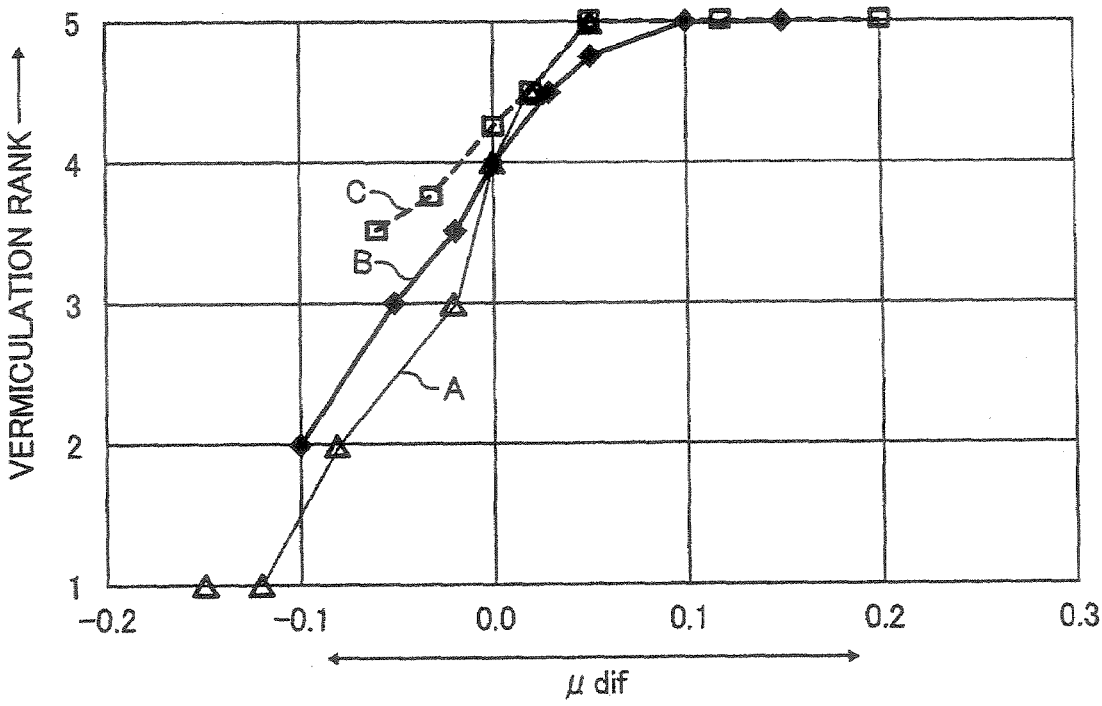
FIG. 3 is a graph for explaining a relationship between a vermiculate false image rank and a difference of surface friction coefficient between a photoconductor and an intermediate transfer belt.

FIG. 3 shows a survey result. In FIG. 3, the horizontal axis represents a difference of the friction coefficient (abbreviated as "μ dif" in FIG. 3) between the photoconductor 7 and the intermediate transfer belt 1, wherein a difference is zero-centered and is greater as a numerical indication grows. More specifically, when the difference of the coefficient is greater than 0.0 in the graph of FIG. 3, it means that the photoconductor 7 has the friction coefficient smaller than that of the intermediate transfer belt 1. Also, the vertical axis represents ranks (i.e., 1-5) of the vermiculate image, wherein a vermiculate image becomes worse as a numerical indication grows from 1 to 5 and the vermiculate image with the rank of 4 or higher is regarded as an allowable level. In FIG. 3, lines A, B, and C indicate the results of cases in which the friction coefficient of the photoconductor 7 is set to 0.4, 0.3, and 0.25, respectively. In each of the cases (i.e., with the lines A, B, and C), the friction coefficient of the intermediate transfer belt 1 is adjusted by relatively small variations. From this resultant graph of FIG. 3, it is understood that the three cases with the lines A, B, and C have a common tendency that the vermiculate image rank remains within an allowable level as long as the friction coefficient of the photoconductor 7 is smaller than that of the intermediate transfer belt 1.

Figure 4:
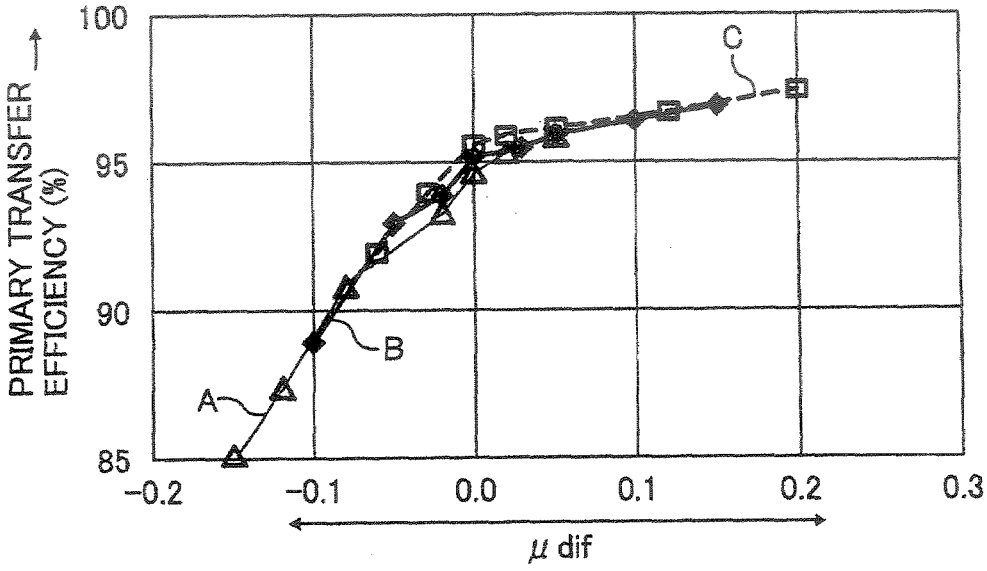
FIG. 4 is a graph for explaining a relationship between an efficiency grade of performance of a primary image transfer and a difference of surface friction coefficient between a photoconductor and an intermediate transfer belt.

FIG. 4 shows another survey result. In FIG. 4, the horizontal axis represents the difference of the friction coefficient between the photoconductor 7 and the intermediate transfer belt 1, as in the case of FIG. 3. The vertical axis represents an efficiency of performance of the primary transfer indicated in percentage with a maximum of 100. That is, when the efficiency is indicated as a value of 100, it means that hundred percents of toner particles have been transferred from the photoconductor 7 onto the intermediate transfer belt 1 without leaving any toner particles on the photoconductor 7, which may not be possible in reality.

In FIG. 4, as in the case of FIG. 3, lines A, B, and C indicate the results of cases in which the friction coefficient of the photoconductor 7 is set to 0.4, 0.3, and 0.25, respectively. Also, in each of the cases (i.e., with the lines A, B, and C), the friction coefficient of the intermediate transfer belt 1 is adjusted by relatively small variations. From this graph of FIG. 4, it is understood that the three cases with the lines A, B, and C have a common tendency that the efficiency of image transfer is greatly affected by the difference of friction coefficient between the photoconductor 7 and the intermediate transfer belt 1. More specifically, the efficiency of image transfer is increased as the difference of friction coefficient between the photoconductor 7 and the intermediate transfer belt 1 increases, that is, as the friction coefficient of the pohotoconductor 7 is small relative to that of the intermediate transfer belt 1.

Therefore, in the color image forming apparatus 100, the vermiculate image is eliminated and the efficiency of the image transfer is improved by lowering the friction coefficient of the photoconductor 7 relative to that of the intermediate transfer belt 1. Lowering the friction coefficient is achieved by reducing the amount of supplying the lubricant to the intermediate transfer belt 1 relative to the supply amount of lubricant to the photoconductor 7.

Also, a survey was conducted in connection with the relationship between the curled-up cleaning blade phenomenon and the surface friction coefficients of the intermediate transfer belt 1 and the secondary transfer roller 13. In this survey, a supply amount of the lubricant to each of the intermediate transfer belt 1 and the secondary transfer roller 13 is adjusted so as to substantially equalize the surface friction coefficients of these two components. With the equalized surface friction coefficients, a job of series image forming operations for about 100000 recording mediums is performed so as to evaluate an occurrence nature of the curled-up cleaning blade, i.e., in which case the curled-up cleaning blade easily occurs. FIG. 5 shows the survey results. Numerals 0.20, 0.30, and so forth represent the surface friction coefficient commonly applied to the intermediate transfer belt 1 and the secondary transfer roller 13.

As shown in FIG. 5, the curled-up cleaning blade does not occur when the intermediate transfer belt 1 has the surface friction coefficient of 0.20, 0.30, and 0.23 and when the secondary transfer roller 13 has the surface friction coefficient of 0.20 and 0.30. However, the curled-up cleaning blade occurs when the number of conveyed recording sheets is 80000 and 5000, which represent a job performance of series image forming operations, with the intermediate transfer belt 1 having a surface friction coefficient of 0.35 and 0.45, respectively. Also the curled-up cleaning blade occurs when the number of conveyed recording sheets is 75000, 10000, and 100, which represent a job performance of series image forming operations, with the secondary transfer roller 13 having a surface friction coefficient of 0.32, 0.35, and 0.45, respectively.

From the above-described results, it is understood that the cleaning blade held in contact with the secondary transfer roller 13 has a greater tendency to easily cause the curling up problem than the cleaning blade held in contact with the intermediate transfer belt 1. Also, the cleaning blade held in contact either with the secondary transfer roller 13 or the intermediate transfer belt 1 causes the curling up problem more easily with an increase of the surface friction coefficient.

In addition, the cleaning blade of the secondary transfer roller 13 is apt to cause the curling up problem earlier than the cleaning blade of the intermediate transfer belt 1. This leads to an observation that the cleaning blade of the secondary transfer roller 13 is apt to cause the curling up problem more easily than the cleaning blade of the intermediate transfer belt 1.

Accordingly, to prevent the curled-up cleaning blade at the secondary transfer roller 13, the friction coefficient of the secondary transfer roller 13 is needed to be set at least to a value smaller than that of the friction coefficient of the intermediate transfer belt 1. This counter measure is effective, particularly when the friction coefficient of the intermediate transfer belt 1 is set to a value at which the cleaning blade of the intermediate transfer belt 1 does not cause the curling up problem.

Figure 6:
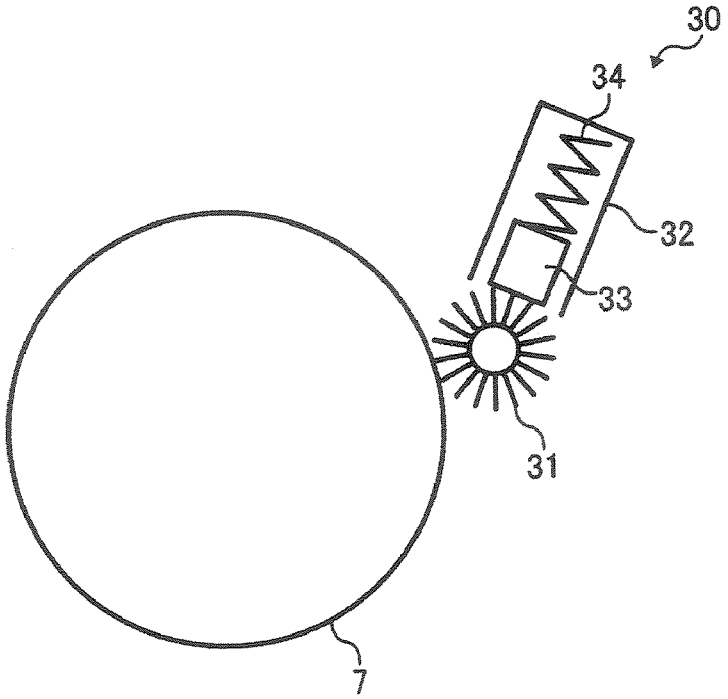
FIGS. 6 and 7 are illustrations for explaining exemplary operations and structures of a lubricant supply mechanism installed on the photoconductor.
Figure 7:
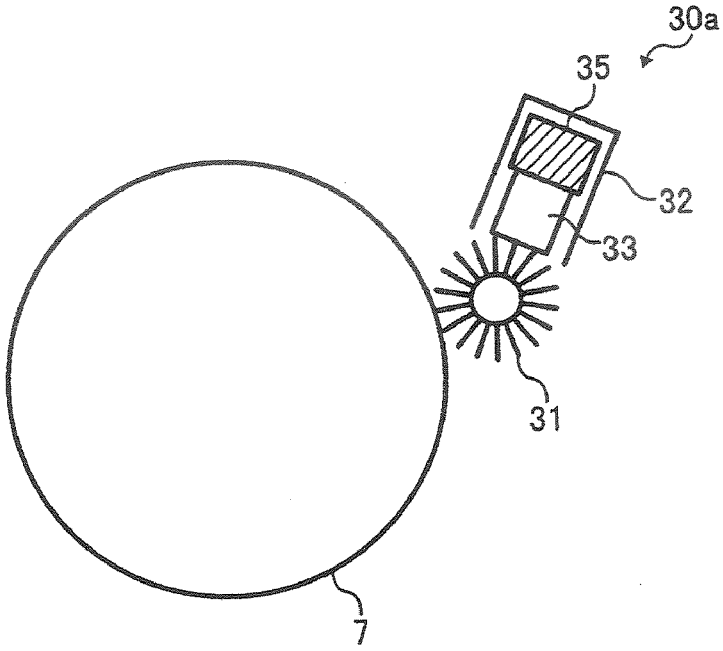

An example operation of the lubricant supply unit 30 installed inside the cleaning unit 11 of the image forming unit 6 is explained with reference to FIGS. 2, 6, and 7. As illustrated in FIG. 2, the lubricant supply unit 30 includes a coating brush 31 and a lubricant agent unit 32. As illustrated in FIG. 6, the lubricant agent unit 32 includes a solid lubricant agent 33 and a spring 34. The solid lubricant agent 33 is pressed towards the coating brush 31 by the spring 34. With this structure, the supply amount of the solid lubricant agent 33 to the photoconductor 7 can be adjusted by changing a pressure of the spring 34. In an alternative lubricant supply unit 30*a*, the spring 34 may be replaced by a weight 35, as illustrated in FIG. 7. The weight 35 has a specific weight and a plurality of weights 35 are provided for a weight selection. In this case, the supply amount of the solid lubricant agent 33 can be adjusted by changing the weight 35 to another weight.

The lubricant supply unit 30 or 30*a* can be provided to each of the photoconductor 7, the intermediate transfer belt 1, and the secondary transfer roller 13. Thereby, it becomes possible to determine the surface friction coefficient of each of the above-mentioned three components so as to be able to set the surface friction coefficient of the intermediate transfer belt 1 to a value greater than those of the photoconductor 7 and the secondary transfer roller 13.

As an alternative, the lubricant supply unit 30 may be installed on each of the photoconductor 7 and the secondary transfer roller 13 but not on the intermediate transfer belt 1. Thus, the lubrication of the intermediate transfer belt 1 is expected to be performed with the lubricant coming down thereto from the photoconductor 7 and the secondary transfer roller 13. In this case, the lubrication of the intermediate transfer belt 1 is performed only indirectly and therefore the supply amount of the solid lubricant agent 33 to the intermediate transfer belt 1 is less than those to the photoconductor 7 and the secondary transfer roller 13. As a result, the surface friction coefficient of the intermediate transfer belt 1 is set to a value greater than those of the photoconductor 7 and the secondary transfer roller 13.

Furthermore, the photoconductor 7 may be provided with an additional surface layer having a relatively low surface friction coefficient. This arrangement is to satisfy a preferable relationship of the photoconductor 7, the secondary transfer roller 13, and the intermediate transfer belt 1, in which the surface friction coefficients of the photoconductor 7 and the secondary transfer roller 13 are set to values smaller than that of the intermediate transfer belt 1.

The surface layer of the photoconductor 7 may generally include at least one of materials such as styrene-acrylonitrile copolymer, styrene-butadiene copolymer, acrylonitrile butadiene styrene copolymer, olefin vinyl monomer, chlorinated polyether, aryl, phenol, polyacetal, polyamide, polyamide-imide, polyacrylate, polyaryl sulfone, polybutylene, polybutylene terephthalate, polycarbonate, polyether sulfone, polyethylene, polyethylene terephthalate, polyimide, acryl, polymethylpentene, polypropylene, polyphenylene oxide, polysulfon, polyulethane, polyvinyl chloride, polyvinylidene chloride, epoxy, etc.

To the plastic selected from among those listed above, particles of fluoroplastic, polyolefin, silicone plastic, or the like may be added as a lubricant to reduce the friction coefficient of the surface layer of the photoconductor 7.

Examples of fluoroplastic include polymers such as tetrafuluoroethylene, hexafuluoropropylene, chlorotrifluoroethylene, vinylidene fluoride, vinyl fluoride, and perfluoroalkylvinylethylene, etc., and copolymers of these polymers can also be used.

Examples of polyolefin include a single olefin polymer such as ethylene, propylene, butane, and the like, and copolymers of heterogeneous olefins. Also, substances thermally-denatured from these polymers and copolymers can be alternatives, such as polyethylene, polypropylene, polybutene, polyhexene, ethylene-propylene copolymer, ethylene-butene copolymer, ethylene-propylene-hexene copolymer, and the like.

Examples of silicone plastic include a substance insoluble in an organic solution, having a network bonding structure in which a siloxane bond is made in three dimension and in which a silicon atom is substituted by alkyl, aryl, amino-substituting alkyl, dialkyl silicone, and the like.

The photoconductor 7 covered by the surface layer made of the above-mentioned materials may have a surface friction coefficient of from approximately 0.1 to approximately 0.3, while the intermediate transfer belt 1 has in general a surface friction coefficient of from approximately 0.35 to approximately 0.7.

The applicant of this invention led a successful experimental result to eliminate the problematic phenomenon of the vermiculate image and to improve the efficiency of image transfer by using the thus-prepared photoconductor 7 having a relatively low surface friction coefficient and the intermediate transfer belt 1 having a surface friction coefficient higher than the photoconductor 7.

In addition, the lubricant supply unit 30 may be installed on the secondary transfer roller 13 (see FIG. 10) to prevent an occurrence of the phenomenon of the curled-up cleaning blade. A preferable installation position of the lubricant supply unit 30 will be described below.

Referring to FIG. 8, a summary of the experimental results by the applicant is explained. In FIG. 8, condition numbers 1-8 indicate various conditions in combinations of lubricant coating and non-coating to the photoconductor 7, the intermediate transfer belt 1, and the secondary transfer roller 13. For example, the condition number 1 represents a condition in which the three components are all coated. In the condition number 2, the photoconductor 7 is not coated while other two components are coated. In the condition number 3, the secondary transfer roller 13 is not coated while other two components are coated. In the condition number 4, the intermediate transfer belt 1 is non coated while other two components are coated. In the condition number 5, the secondary transfer roller 13 is coated while other two components are non coated. In the condition number 6, the photoconductor 7 is coated while other two components are not coated. In the condition number 7, the intermediate transfer belt 1 is coated while other two components are not coated. In the condition number 8, the three components are all not coated.

The condition numbers 1-8 also indicate results with respect to the phenomena of the curled-up cleaning blade and the vermiculate image and the degree of image transfer efficiency. For example, the phenomenon of the curled-up cleaning blade did not appear under the conditions represented by the condition numbers 1-7 but did appear under the condition of the condition number 8. The vermiculate image did not appear under the conditions of the condition numbers 5, 6, and 8 but did appear under the conditions of the condition numbers 1-3 and 7. Under the condition of the condition number 4, the grade of the vermiculate image was allowable but just on the borderline. The image transfer was allowable under the conditions of the condition numbers 5, 6, and 8 but not allowable under the conditions of the condition numbers 1, 2, and 7. Under the condition of the condition numbers 3 and 4, the grade of the image transfer was allowable but just on the borderline.

Based on the above summary, it is understood that the three observation targets, i.e., the curled-up cleaning blade, the vermiculate image, and the image transfer efficiency, altogether cleared the allowable levels under the conditions of the condition numbers 4-6. That is, the condition numbers 4-6 are preferable, in which at least one of the photoconductor 7, the intermediate transfer belt 1, and the secondary transfer roller 13 was lubricated.

In further details, however, the condition numbers 5 and 6 led the result that the three observation targets sufficiently cleared the allowable levels while the condition number 4 led the result that the vermiculate image and the image transfer grade were allowable levels but just on the borderline. From this, it is understood that the conditions of the condition numbers 5 and 6 are more preferable. That is, the more preferable condition was that at least one of the photoconductor 7 and the secondary transfer roller 13 was lubricated while the intermediate transfer belt 1 was not lubricated.

Figure 9:
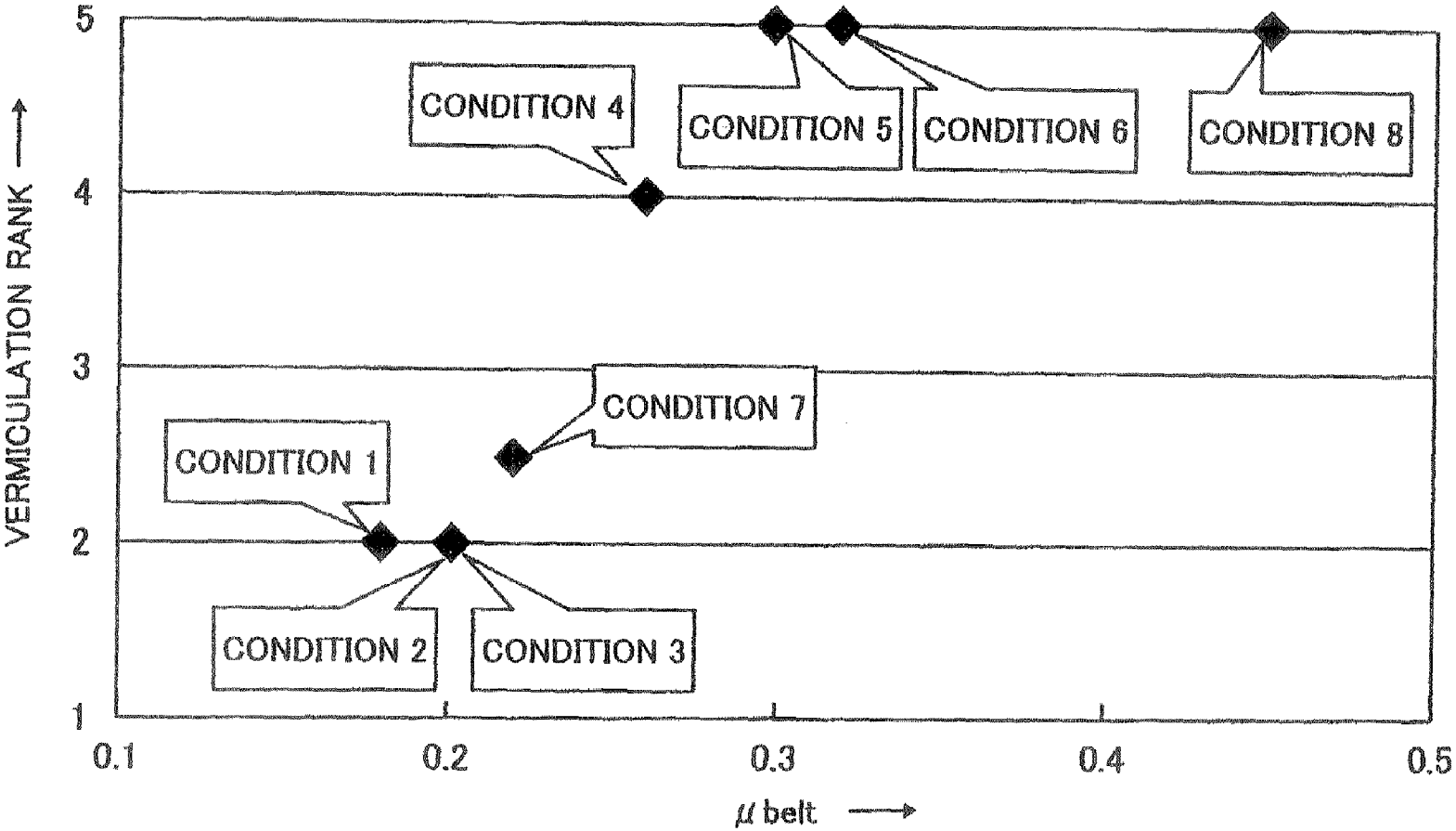
FIG. 9 is graph for explaining a relationship between the vermiculate false image rank and the surface friction coefficient of the intermediate transfer belt.

The intermediate transfer belt 1 is located at a position to be able to receive the lubrication transported from both of the photoconductor 7 and the secondary transfer roller 13. Therefore, it is assumed that the surface friction coefficient of the intermediate transfer belt 1 can be reduced to a preferable extent without impairment of performance of the primary transfer. This assumption may be the reason that the conditions of the condition numbers 4-6 led to the preferable results. In order to make this assumption more sure, a further survey was conducted. In this survey, the surface friction coefficient of the intermediate transfer belt 1 was measured in each of the conditions of the condition numbers 1-8. Then, the measurement results was examined in connection with the phenomenon of the vermiculate image. FIG. 9 shows a summary of the examination.

In FIG. 9, the horizontal axis represents a degree of the surface friction coefficient of the intermediate transfer belt 1, which is abbreviated as "μ belt." The vertical axis represents vermiculation ranks 1-5, i.e., an occurrence degree of a vermiculation-like erroneous density drop varying from a worst rank 1 to a best rank 5. The intermediate transfer belt 1 was lubricated in the cases of the condition numbers 1, 2, 3, and 7, having a low friction coefficient approximately around 0.2, as shown in FIG. 9. The vermiculate ranks of these cases are all below approximately 2.5 which is far inferior.

On the other hand, a higher surface friction coefficient of the intermediate transfer belt 1 and a higher vermiculate rank are indicated in the case of the condition number 4, lubricating both the photoconductor 7 and the secondary transfer roller 13 but not the intermediate transfer belt 1. That is, the intermediate transfer belt 1 has a friction coefficient of around approximately 2.5 and the vermiculate rank is 4.

Further, a still higher surface friction coefficient of the intermediate transfer belt 1 and a still higher vermiculate rank are indicated in the cases of the condition numbers 5 and 6 in which lubrication was made on one of the photoconductor 7 and the secondary transfer roller 13 but not the intermediate transfer belt 1. That is, the intermediate transfer belt 1 has a friction coefficient of around approximately 0.3 and the vermiculate rank is substantially 5. Moreover, the case of the condition number 8, in which no lubrication was made on the three components, shows a further higher surface friction coefficient of the intermediate transfer belt 1 around 0.45 and a vermiculate rank of 5. However, the curled-up cleaning blade occurred in this case.

Based on the above-described examination, it is understood that both of a defect primary image transfer such as the vermiculate image and the curled-up cleaning blade can effectively be avoided by making a lubrication to one of the photoconductor 7 and the secondary transfer roller 13 but not the intermediate transfer belt 1. This is because such an arrangement allows an indirect lubrication to the intermediate transfer belt 1 with the lubricant moved from the photoconductor 7 and the secondary transfer roller 13 and the surface friction coefficient of the intermediate transfer belt 1 can be reduced to a preferable extent without impairment of performance of the primary transfer.

There is more factors other than the above-described lubrication, affecting the occurrence of the curled-up cleaning blade in particular. Specifically, a job of a series image forming operation without images (e.g., a white image) may extremely reduce a toner supply amount to the belt cleaning blade 21 of FIG. 1 which may cause the curled-up problem.

To address the above problematic situation, the color image forming apparatus 100 of FIG. 1 is provided with an image forming procedure for forming a toner image for a lubrication purpose during an interval between regular image forming operations. Such a lubrication toner image is formed with the image forming unit 6 (i.e., one of the image forming units **6*a*-6*d*) and is transferred onto the intermediate transfer belt 1. The color image forming apparatus 100 arranges to omit the transportation of the recording medium in this case so that the toner of the image formed on the intermediate transfer belt 1 is supplied to the belt cleaning blade 21**.

In one exemplary procedure, the color image forming apparatus 100 forms a dummy toner image once in ten regular image forming operations so as to supply the toner to the belt cleaning blade 21. For example, the dummy toner image is a solid black image with a width covering a full image forming area in the main scanning direction and a length of 3 mm in the sub-scanning direction.

This procedure was experimentally performed on two cases. In a first case, the color image forming apparatus 100 is configured to lubricate the photoconductor 7 and the secondary transfer roller 13. In a second case, the color image forming apparatus 100 is configured to lubricate only one of the photoconductor 7 and the secondary transfer roller 13. As a result, in the first case, the belt cleaning blade 21 caused the curling up problem during the procedure of 10000 recording mediums. However, the second case did not cause the problem of the curled-up cleaning blade through the test of 10000 recording mediums. Therefore, it is confirmed that this procedure using the dummy toner image is effective to prevent the belt cleaning blade 21 from curling up.

Based on the above test result, it is preferable to make the dummy toner image adjustable, for example, in a size and a density of the image, and a frequency of performance, depending upon modes of the image forming operation. This is because the lubricant supply amount from the photoconductor 7 and the secondary transfer roller 13 to the intermediate transfer belt 1 may not be sufficient, depending upon modes of the image forming operation. For example, the curled-up cleaning blade may occur when a time length that the secondary transfer roller 13 contacts the intermediate transfer belt 1 is relatively short.

For example, a full color image forming mode typically sets an interval between image forming to a relatively longer time length in order to secure a performance of image fixing by the fixing roller pair 16. On the other hand, a black-and-white image forming mode typically sets the interval to a relatively shorter time length so as to contribute to a relatively high productivity. Accordingly, in the black-and-white image forming mode, a gap between two adjacent recording mediums is narrowed, so that a time length that the secondary transfer roller 13 contacts the intermediate transfer belt 1 is relatively short.

As a consequence, the lubrication from the secondary transfer roller 13 to the intermediate transfer belt 1 is reduced. In the case the lubricant supply unit 30 installed on the photoconductor 7 is in operation, the lubricant attached on a non-image area is normally moved to the intermediate transfer belt 1 but the lubricant attached on an image area is hardly moved to the intermediate transfer belt 1. Thus, the black-and-white image forming mode which usually has a less non-image area may cause an insufficient amount of lubrication from the photoconductor 7. Therefore, the lubrication toner image needs to be adjustable.

For another example, the image forming mode is different when the image forming is performed for 100 times with a single image and when the image forming is performed for 100 times with all different images, for example. These modes differ the interval between the two consecutive image forming operations. Therefore, the dummy toner image needs to be adjusted. As described above, the dummy toner image can be adjusted, for example, in a size and a density of the image, and a frequency of performance.

The adjustment of the image density is to change a toner attraction amount in a unit area. For example, the toner attraction amount in a unit area is increased in the black-and-white image forming mode and a mode having a relatively large number of repetitive reproduction with a single image. The change of the image density is limited depending upon a capability of the developing unit 9 employed.

The adjustment of the image area is to change the length (e.g., 3 mm) in the sub-scanning direction. This adjustment can be made as desired, regardless of the capability of the developing unit 9.

The adjustment of the performance frequency is to change the interval (e.g., once in ten regular image forming operations) to once in five regular image forming operations, for example. This change can be made as desired, regardless of the capability of the developing unit 9.

In this way, the color image forming apparatus 100 can reliably prevent the phenomenon of the curled-up cleaning blade without reducing the surface friction coefficient of the intermediate transfer belt 1 by performing an insertion of the dummy toner image.

Next, details of the lubricant supply unit 30 installed on the secondary transfer roller 13 is explained. As described above, when the color image forming apparatus 100 performs the dummy toner image formation to supply the toner to the belt cleaning blade 21, the dummy toner image formed on the intermediate transfer belt 1 is made in contact with the secondary transfer roller 13 before being supplied to the belt cleaning blade 21. As a result, the dummy toner image is transferred onto the secondary transfer roller 13. Via the secondary transfer roller 13, the dummy toner image is transferred onto a back surface of the recording medium P. As a result, the recording medium P becomes dirty.

Figure 10:
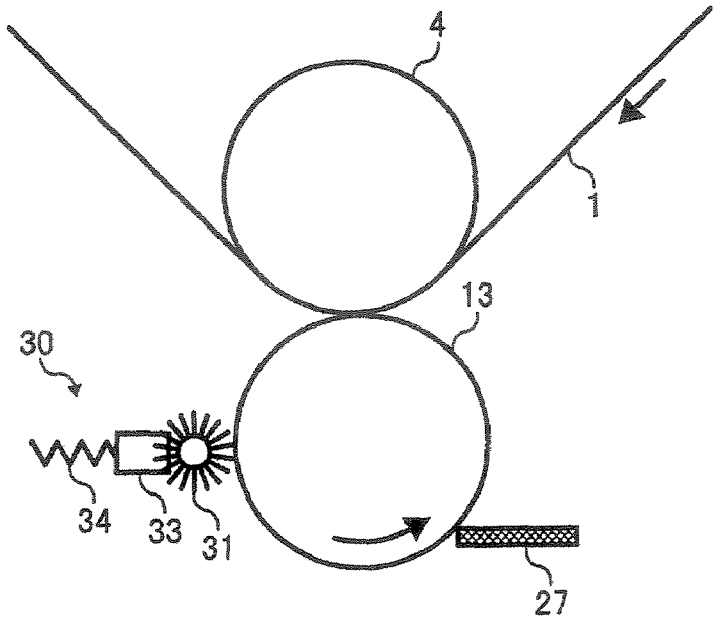
FIGS. 10 and 11 are illustrations of the lubricant supply mechanisms installed on the secondary transfer roller.

Therefore, the secondary transfer roller 13 is provided with a cleaning blade 27, as illustrated in FIG. 10. However, the secondary transfer roller 13 needs to reliably release the recording medium P and to prevent the recording medium P from folding around. Therefore, the secondary transfer roller 13 has a relatively small diameter. This increases a risk of causing the blade curling. To address this problem, the lubricant supply unit 30 is needed to be provided to the secondary transfer roller 13.

As illustrated in FIG. 10, the lubricant supply unit 30 is disposed at a position downstream from a secondary transfer area formed between the roller 4 and the secondary transfer roller 13 in the rotation direction of the secondary transfer roller 13. Also, the position of the lubricant supply unit 30 is upstream from the cleaning blade 27 in the rotation direction of the secondary transfer roller 13. Thus, the lubricant is provided before the position of the cleaning blade 27, and the cleaning blade 27 removes contaminants on the secondary transfer roller 13 before the secondary transfer area.

In the case of FIG. 10, the contaminants may include a dust from the recording medium P which may disturb the cleaning performance. The lubricant coating brush 31 is therefore serving as a cleaning tool for the dust from the recording medium P.

Figure 11:
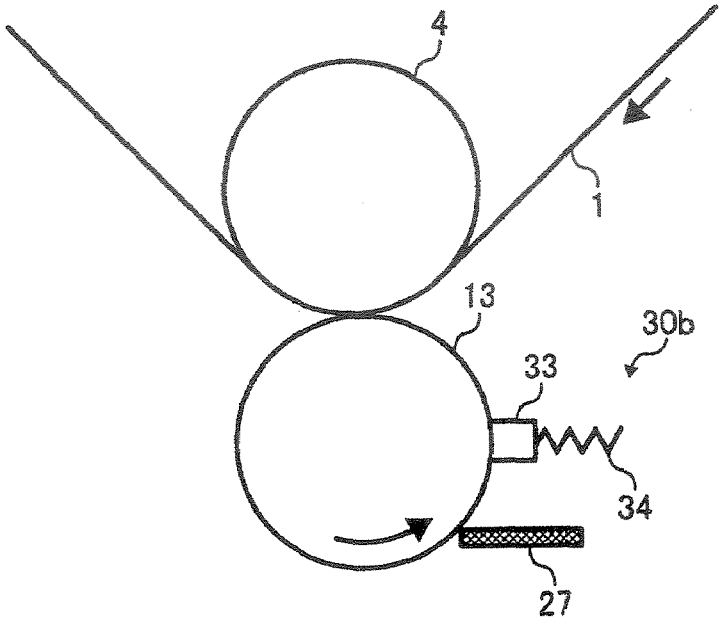

It is also possible, as illustrated in FIG. 11, to arrange a lubricant supply unit **30*b* at a position downstream from the cleaning blade 27 and upstream from the secondary transfer area. The lubricant supply unit 30*b* is similar to the lubricant supply unit 30, except for a deletion of the lubricant coating brush. In this case, the lubricant is supplied directly to the secondary transfer roller 13 by the lubricant 33 after the cleaning blade 27 removes the contaminants on the secondary transfer roller 13**.

What still remains is a concern about the undesirable transfer of the toner image from the intermediate transfer belt 1 to the secondary transfer roller 13, even with the configuration shown in FIGS. 10 and 11. The undesirable transfer of the toner image increases the risk of the curled-up cleaning blade. Addressing this concern by increasing a toner supply amount may fall an increase of wasting toner.

To prevent this phenomenon, the color image forming apparatus 100 is configured to change a bias voltage applied to the secondary transfer roller 13. That is, the color image forming apparatus 100 applies a regular bias voltage to the secondary transfer roller 13 during the regular image forming operation. However, the color image forming apparatus 100 applies a smaller bias voltage to the secondary transfer roller 13 during the intervals between the regular image forming operations in which the dummy toner image may be formed. This arrangement reduces an amount of toner transfer from the intermediate transfer belt 1 to the secondary transfer roller 13. Thereby, a sufficient toner supply to the cleaning blade 21 can be maintained so as to prevent an occurrence of the curled-up cleaning blade.

An alternative adjustment of the lubricant supply is now explained. In the lubricant supply unit 30 of FIG. 2, the lubricant 22 is pressed towards the photoconductor 7 by the spring 34, as described above. This method, however, may not be flexible to various changes in the conditions of the image forming operation. A supply amount of the lubricant 33 may differ between the cases when the lubricant 33 is newly installed (i.e., a small contact area and a small supply amount) and when the lubricant 33 is already in use (i.e., a regular contact area and a regular supply amount). It is therefore preferable to vary the lubricant supply amount depending on the cases. For example, the revolution of the lubricant coating brush 31 may preferably be varied with a driving mechanism (not shown) such as a motor, for example, to change a supply amount of the lubricant 33. Alternatively, an eccentric cam, for example, may be used to push the spring 34 to change the position of the spring 34 so as to vary a pressure to the lubricant 33. These methods for flexibly varying the lubricant supply amount can be applied to any one of the lubricant supply units 30, 30*a,* and 30*b.*

Figure 12:
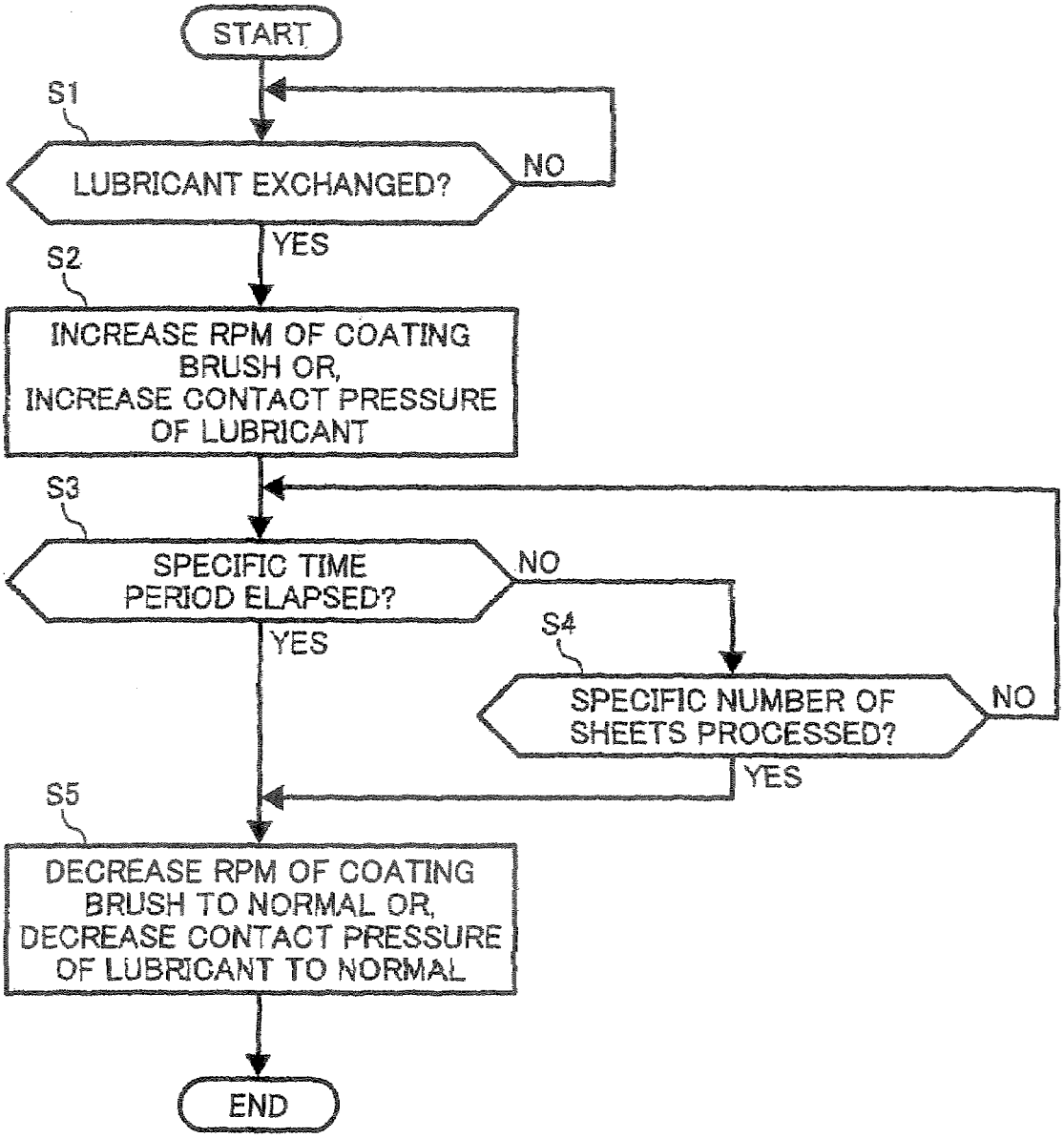
FIG. 12 is a flowchart for explaining an exemplary procedure of a lubricant supply amount control operation performed by the color image forming apparatus of FIG. 1.

FIG. 12 demonstrates an exemplary procedure of a control operation in connection with the lubricant supply unit 30. In FIG. 12, an event of exchanging the lubricant 33 is observed in Step S1. When the lubricant 33 is exchanged and the observation result of Step S1 is YES, the process goes to Step S2 in which the pressure or the revolution of the lubricant coating brush 31 is increased. Then, in Steps S3 and S4, it is determined whether a specific time period is elapsed and whether a specific number of recording mediums P is processed. When one of Steps S3 and S4 falls YES, the process goes to Step S5 in which the pressure or the revolution of the lubricant coating brush 31 increased in Step S2 is returned to the regular adjustment.

In this way, the color image forming apparatus 100 can automatically adjust the lubricant supply amount at a substantially constant manner between the cases when the lubricant 33 is newly changed and when the lubricant 33 is already in use.

Also, a supply amount of the lubricant 33 may differ between the cases having different size toner images since the lubricant is apt to be consumed more with a larger toner image due to a greater friction with toner. With a small toner image, the lubricant is apt to be consumed less due to a small friction with toner. This may cause an inferior performance of the primary transfer process and accordingly lead to the problem of the cleaning blade curling.

In such a case, the above-described control procedure shown in FIG. 12 can be applied so that the supply amount of the lubricant 33 can be increased when a toner image is relatively large and decreased when a toner image is relatively small.

For this feature, it is preferable to provide a memory to store a predetermined threshold value and accumulated data of image areas processed during a predetermined past time period, for example. Switching between small and large supply amounts of lubricant may be determined based on a comparison result between the predetermined threshold value and the accumulated data stored in the memory. Levels of adjusting the lubricant supply amount can be more than two on an as needed basis.

Furthermore, it is also preferable to store in a memory a predetermined threshold value and accumulated data of image areas processed during a predetermined unit time period, instead of the predetermined past time period. Switching between small and large supply amounts of lubricant may be determined based on a comparison result between the predetermined threshold value and the accumulated data during the predetermined unit time period stored in the memory. The reason for this is that operation time lengths are different between cases of reproducing a single image in a continuous mode and in a one-by-one mode. The friction coefficient is apt to be increased with a large toner amount processed during a unit time period and is decreased with a small toner amount during the unit time period. Therefore, the lubricant supply amount is increased when the accumulated data during the unit time period is greater than the threshold value and is decreased when the accumulated data during the unit time period is smaller than the threshold value.

This invention may be conveniently implemented using a conventional general purpose digital computer programmed according to the teachings of the present specification, as will be apparent to those skilled in the computer art. Appropriate software coding can readily be prepared by skilled programmers based on the teachings of the present disclosure, as will be apparent to those skilled in the software art. The present invention may also be implemented by the preparation of application specific integrated circuits or by interconnecting an appropriate network of conventional component circuits, as will be readily apparent to those skilled in the art.

Numerous additional modifications and variations are possible in light of the above teachings. It is therefore to be understood that within the scope of the appended claims, the disclosure of this patent specification may be practiced otherwise than as specifically described herein.

This patent specification is based on Japanese patent application, No. JPAP2005-333479 filed on Nov. 18, 2005 in the Japan Patent Office, the entire contents of which are incorporated by reference herein.

What is claimed is:

1. An image forming apparatus, comprising:

an image carrying mechanism configured to sequentially carry a plurality of primary separate color toner images thereon;

an intermediate transfer member rotatably held in contact with the image carrying mechanism;

a primary transfer mechanism configured to sequentially transfer the plurality of primary separate toner images from the image carrying mechanism onto the intermediate transfer member at a specific position into a color toner image;

a secondary transfer mechanism held in contact with the intermediate transfer member and configured to transfer the color toner image from the intermediate transfer member onto a recording medium; and a lubricant supply mechanism configured to supply a lubricant to at least one of the image carrying mechanism, the intermediate transfer member, and the secondary transfer mechanism, and the lubricant supply mechanism including an adjusting mechanism configured to adjust an amount of supplying the lubricant to the at least one of the image carrying mechanism, the intermediate transfer member, and the secondary transfer mechanism, wherein the adjusting mechanism is configured to increase an amount of supplying the lubricant to a value greater than a regular amount when the lubricant supply mechanism is replenished with a fresh lubricant.

2. The image forming apparatus of claim 1, wherein the lubricant supply mechanism further includes:

a coating roller configured to coat the lubricant, and wherein the adjusting mechanism adjusts an amount of supplying the lubricant by varying a revolution number of the coating roller.

3. The image forming apparatus of claim 1, wherein the lubricant supply mechanism further includes:

a coating roller configured to coat the lubricant, and wherein the adjusting mechanism adjusts an amount of supplying the lubricant by varying a pushing pressure of the coating roller relative to the at least one of the image carrying mechanism, the intermediate transfer member, and the secondary transfer mechanism.

4. The image forming apparatus of claim 1, wherein the lubricant supply mechanism directly supplies the lubricant to the at least one of the image carrying mechanism, the intermediate transfer member, and the secondary transfer mechanism, and the adjusting mechanism adjusts an amount of supplying the lubricant by varying a pushing pressure of the lubricant relative to the at least one of the image carrying mechanism, the intermediate transfer member, and the secondary transfer mechanism.

5. The image forming apparatus of claim 1, wherein the adjusting mechanism adjusts an amount of supplying the lubricant in accordance with an accumulated amount of pixel areas in the color toner images output.

6. The image forming apparatus of claim 1, wherein the adjusting mechanism adjusts an amount of supplying the lubricant in accordance with an accumulated amount of pixel areas in the color toner images output in a unit of a predetermined time period.

7. An image forming apparatus, comprising:

an image carrying mechanism configured to carry a plurality of primary separate color toner images thereon;

an intermediate transfer member rotatably held in contact with the image carrying mechanism;

a primary transfer mechanism configured to sequentially transfer the plurality of primary separate toner images from the image carrying mechanism onto the intermediate transfer member at a specific position into a color toner image;

a secondary transfer mechanism held in contact with the intermediate transfer member and configured to transfer the color toner image from the intermediate transfer member onto a recording medium; and a first lubricant supply mechanism configured to supply a lubricant to the image carrying mechanism and the intermediate transfer member, and to supply the lubricant indirectly to the secondary transfer mechanism via the image carrying mechanism and the intermediate transfer member, and including an adjusting mechanism configured to adjust an amount of supplying the lubricant to the image carrying mechanism and the intermediate transfer member, wherein the secondary transfer mechanism includes a second lubricant supply mechanism configured to supply a lubricant to the secondary transfer mechanism, and a cleaning blade configured to clean off a surface of the secondary transfer mechanism, and wherein a lubricant supply position of the second lubricant supply mechanism, a cleaning position of the cleaning blade, and a contact point between the intermediate transfer member and the secondary transfer mechanism are placed in this order in a moving direction of the secondary transfer mechanism.

8. The image forming apparatus of claim 7, wherein the secondary transfer mechanism includes a roller.

9. The image forming apparatus of claim 7, wherein the secondary transfer mechanism includes a belt.

10. An image forming apparatus, comprising:

an image carrying mechanism configured to carry a plurality of primary separate color toner images thereon;

an intermediate transfer member rotatably held in contact with the image carrying mechanism;

a primary transfer mechanism configured to sequentially transfer the plurality of primary separate toner images from the image carrying mechanism onto the intermediate transfer member at a specific position into a color toner image;

a secondary transfer mechanism held in contact with the intermediate transfer member and configured to transfer the color toner image from the intermediate transfer member onto a recording medium; and a first lubricant supply mechanism configured to supply a lubricant to the image carrying mechanism and the intermediate transfer member, and to supply the lubricant indirectly to the secondary transfer mechanism via the image carrying mechanism and the intermediate transfer member, and including an adjusting mechanism configured to adjust an amount of supplying the lubricant to the image carrying mechanism and the intermediate transfer member, wherein the secondary transfer mechanism includes a second lubricant supply mechanism configured to supply a lubricant to the secondary transfer mechanism, and a cleaning blade configured to clean off a surface of the secondary transfer mechanism, and wherein a cleaning position of the cleaning blade, a lubricant supply position of the second lubricant supply mechanism, and a contact point between the intermediate transfer member and the secondary transfer mechanism are placed in this order in a moving direction of the secondary transfer mechanism.

11. The image forming apparatus of claim 10, wherein the secondary transfer mechanism includes a roller.

12. The image forming apparatus of claim 10, wherein the secondary transfer mechanism includes a belt.

* * * * *